United States Patent [19]

Lexer

[11] Patent Number: 4,591,697

[45] Date of Patent: May 27, 1986

[54] INFRARED-RADIATING EQUIPMENT WITH CERAMIC RADIATORS

[75] Inventor: Hans Lexer, Freden, Fed. Rep. of Germany

[73] Assignee: Manfried Steinmetz, Northeim, Fed. Rep. of Germany

[21] Appl. No.: 553,485

[22] Filed: Nov. 18, 1983

[30] Foreign Application Priority Data

Dec. 3, 1982 [DE] Fed. Rep. of Germany ..... 3244793

[51] Int. Cl.[4] ..... H05B 3/48

[52] U.S. Cl. ..... 219/348; 219/347; 219/349; 219/351; 219/354

[58] Field of Search ..... 219/347, 348, 349, 354, 219/345, 350, 351, 352, 353, 343

[56] References Cited

U.S. PATENT DOCUMENTS 2,610,280 9/1952 Wilson ..... 219/348
3,141,089 7/1964 Hultgreen ..... 219/354
4,333,003 6/1982 Rivera ..... 219/354

FOREIGN PATENT DOCUMENTS 2052304 4/1972 Fed. Rep. of Germany .
618978 3/1949 United Kingdom ..... 219/354

OTHER PUBLICATIONS

"Elstein Infrarot-Grossreflektoren . . . " Elstein-Werk, West Germany, 3/1984.

*Primary Examiner*—Clarence L. Albritton
*Assistant Examiner*—Teresa J. Walberg
*Attorney, Agent, or Firm*—Max Fogiel

[57] ABSTRACT

Infrared-radiating equipment having ceramic radiators and reflectors. Any desired number of uniform reflectors are hinged to each other at their longer sides and articulated with bearing bolts. Enough radiators to attain the desired heating effect are accommodated next to each other in a common reflector. The radiators are preferably rod-shaped or rectangular.

8 Claims, 16 Drawing Figures

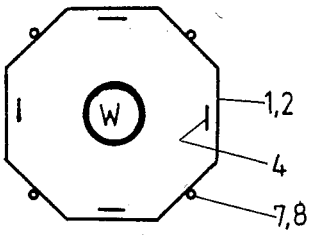
Fig. 9
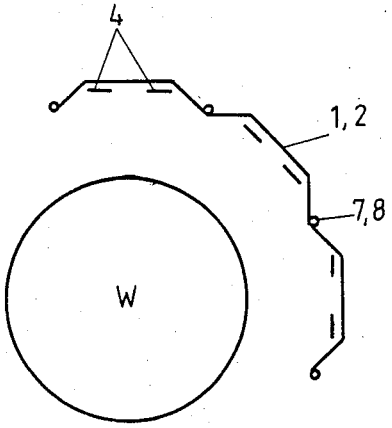
Fig.10
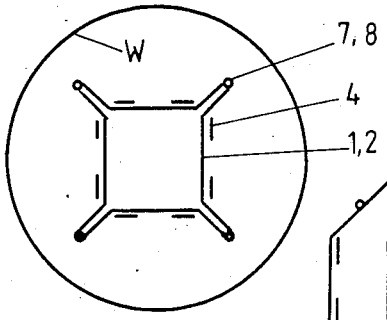
Fig.11
Fig.12
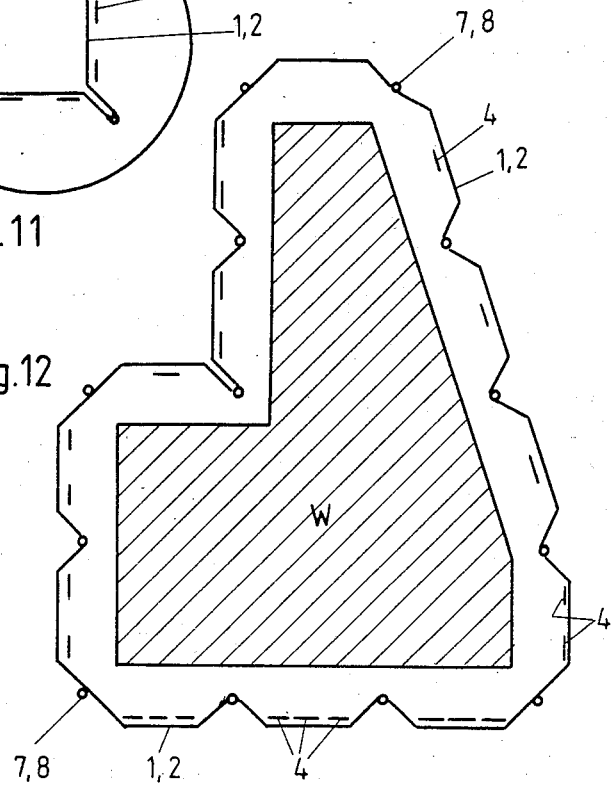

INFRARED-RADIATING EQUIPMENT WITH CERAMIC RADIATORS

BACKGROUND OF THE INVENTION

The present invention relates to infrared-radiating equipment consisting of ceramic radiators surrounded by reflectors. Devices of this kind, like the object of the applicant's German Patent No. 2 052 304, have a reflector surrounding each ceramic radiator on one side and with dimensions that match it. The size of the electric radiators and of their associated reflectors depends on the necessary heat capacity. The various models take up a lot of space when installed. There are also problems with the known radiators and reflectors when the equipment covers a lot of space, especially if the surface of the work piece is not level.

SUMMARY OF THE INVENTION

The object of the present invention is infrared-radiating equipment without the aforesaid defects that can be very easily adapted to particular heat-capacity requirements and to pieces to be irradiated having various geometries without requiring a lot of installation space.

This object is attained in accordance with the invention with reflectors that have hinged, articulated, or similar joints at the edges and that can be connected with bearing or connecting bolts. The hinged or articulated parts allow several reflectors to be connected. The hinged parts themselves are secured by supports like rods, tubes, or similar shapes that extend over several reflectors so that special support structures will not be necessary when the installation is large. Uniform or similar radiators and reflectors are employed to simplify installation.

The reflector in accordance with the invention extends over several radiators and has a series of adjacent connections so that the appropriate number of radiators can be connected up to achieve the desired heat capacity.

It is especially practical for the radiators to be rod-shaped or rectangular and positioned parallel to or across the longitudinal axis of the reflector.

It is practical for the radiators to have supports at the end to hold them in the reflector and for the power connections to be at the end of the radiator.

Some preferred embodiments of the invention will now be described with reference to the attached drawings, wherein

BRIEF DESCRIPTION OF THE DRAWINGS

FIGS. 9–16 are schematic views of infrared-radiating equipment consisting of reflectors and radiators in accordance with the invention and employed for various purposes.

DESCRIPTION OF THE PREFERRED EMBODIMENTS

Figure 1:
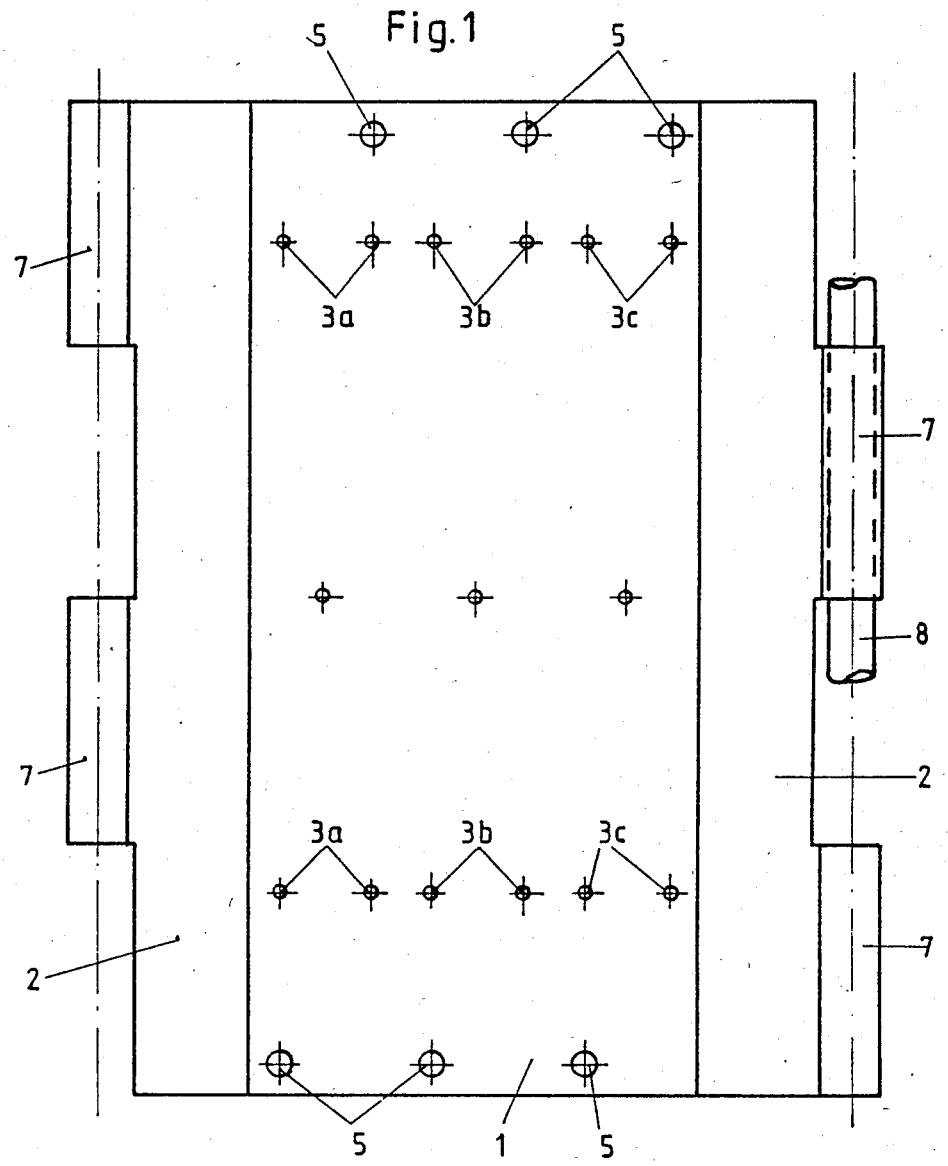
FIG. 1 is a top view of a reflector that can accept three radiators for example, FIG. 2 a section through the reflector in FIG. 1 fitted with two ceramic radiators, FIG. 3 a perspective view of a reflector accommodating three ceramic radiators, FIG. 4 a schematic representation of an articulated connection between several reflectors by means of bearing bolts.
Figure 2:
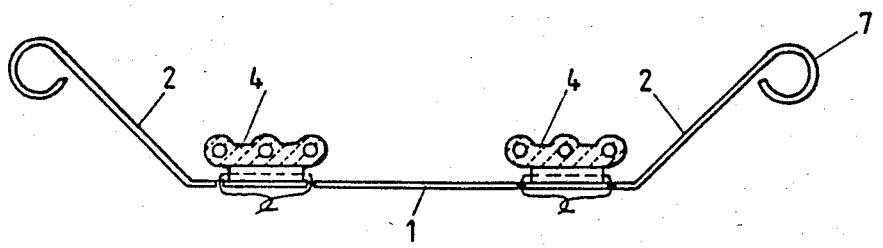
Figure 3:
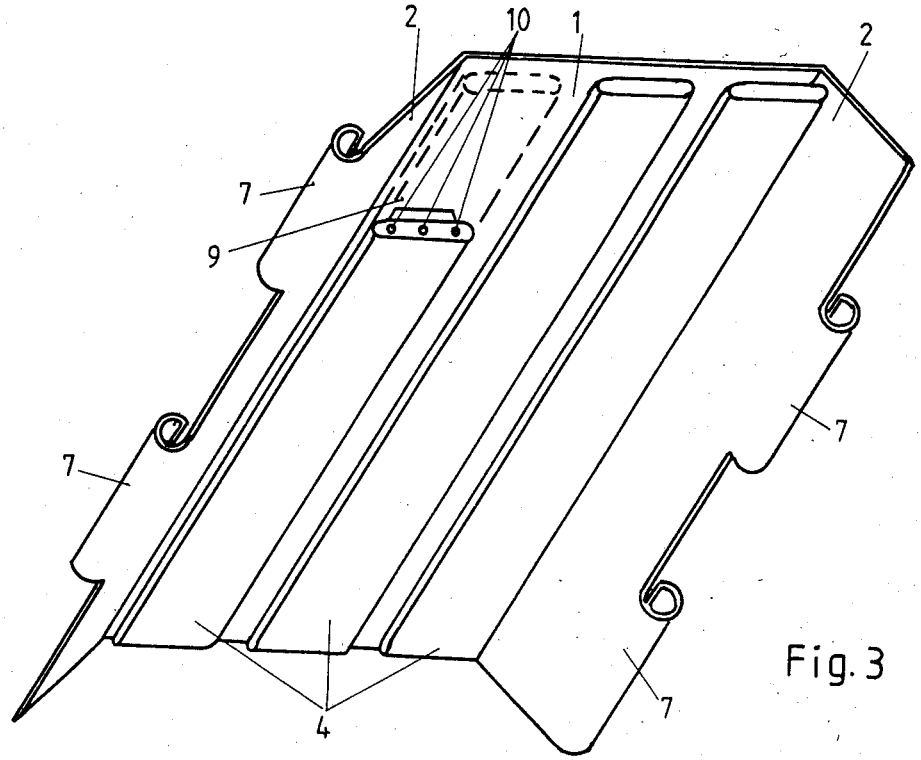
Figure 4:
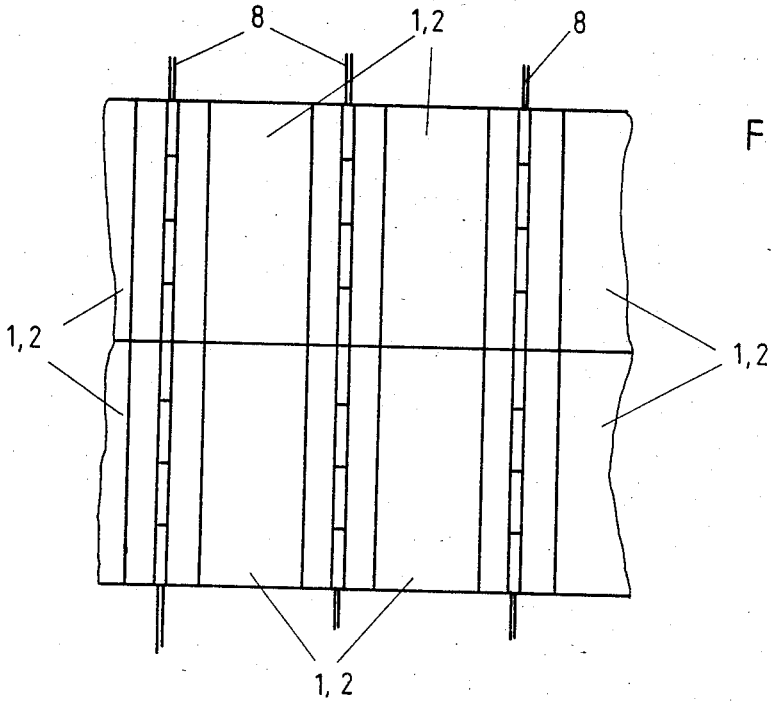

FIGS. 1 and 2 illustrate a reflector constructed of highly polished special steel. The reflector is shaped with sloping walls 2 connected to a correspondingly wide rear 1. Rear 1 has groups 3*a*, 3*b*, and 3*c* of holes for mounting electric radiators 4, to be described later, as desired. There are other holes 5 at the edge that the power lines 6 (FIG. 1) of radiators 4 can pass through.

Finally, the reflector has sleeves 7 at the longitudinal edges of walls 2 that can accept hinge or carrier bolts 8. Sleeves 7 are mutually displaced and at such a distance from each other that the sleeves of another reflector can be inserted between them to form a hinged connection between several reflectors.

Supporting rods or similar shapes can of course also be inserted through sleeves 7 to permit several reflectors to very simply be built up one behind the other into an installation.

As previously mentioned, several ceramic radiators 4 can be accommodated next to each other in a reflector of the type just described depending on the heat capacity desired. Thus, one, two, or three radiators 4 can be attached next to each other or to one of the connections 3*a*, 3*b*, or 3*c*.

The illustrated embodiment of a reflector facilitates positioning as many reflectors as desired next to and behind each other, connected by hinges and adapted to particular requirements and to the surface of the particular article W to be heated, as schematically illustrated in FIGS. 9 through 16.

Figure 5:
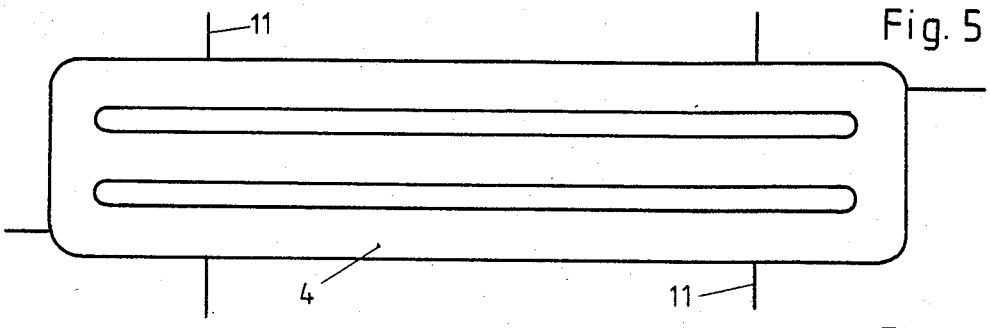
FIGS. 5–7 are a top, side, and bottom view of the type of ceramic radiator preferably employed in equipment in accordance with the invention.
Figure 6:
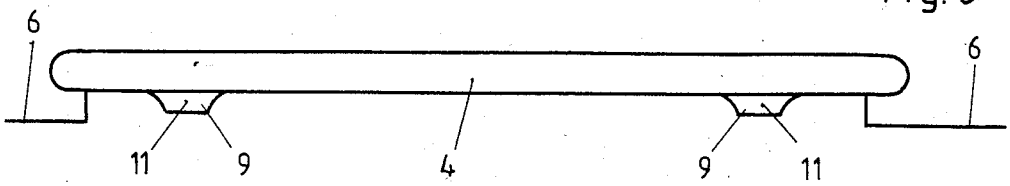
Figure 7:
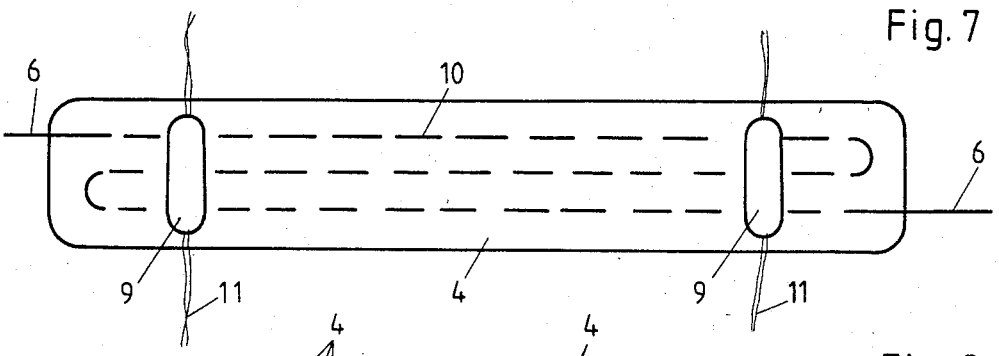
Figure 8:
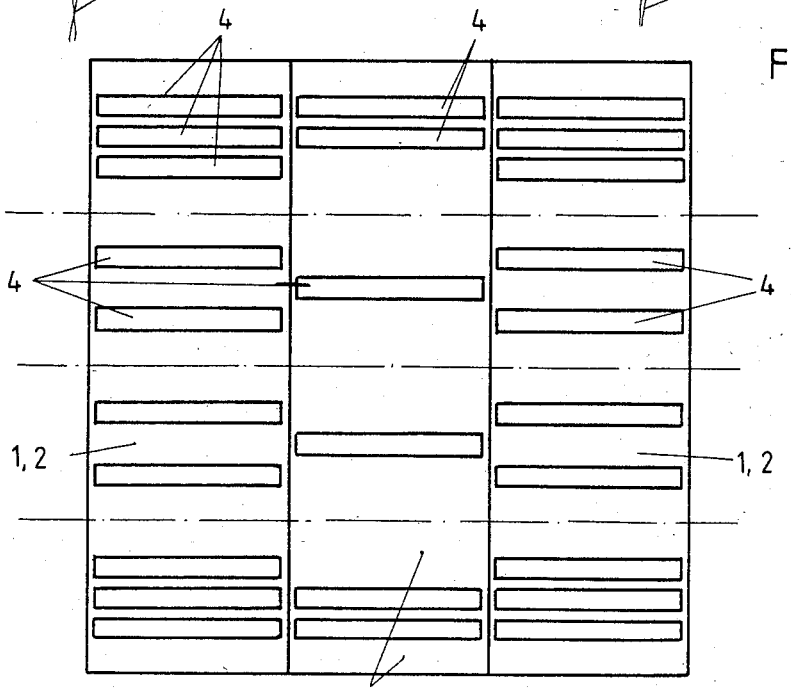
FIG. 8 is an example of how a radiation surface consisting of twelve reflectors can be fitted out.
Figure 13:
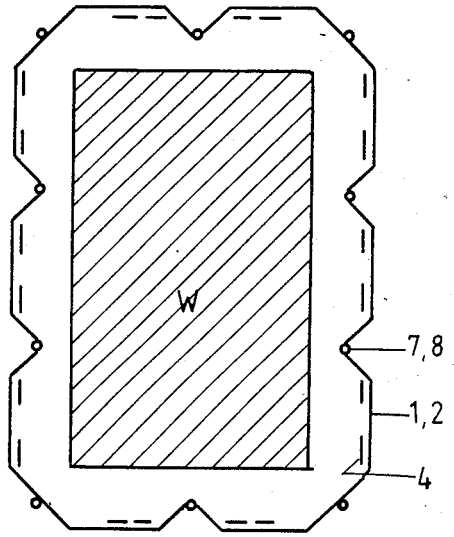
Figure 14:
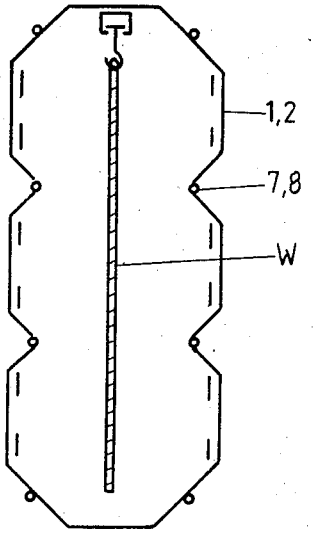
Figure 15:
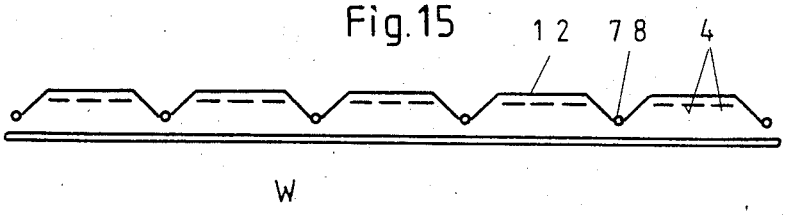
Figure 16:
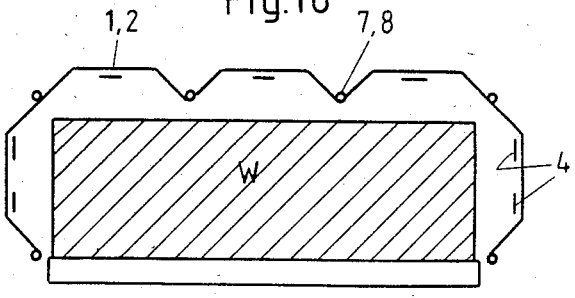

Particularly practical is the embodiment of the ceramic radiators employed. They are, as will be especially evident from FIGS. 5 through 7, long, slender, and rectangular. The heat conductors 10 embedded in the ceramic body extend as indicated by the broken lines in FIG. 7 and merge into the power-supply lines 6 at the ends of each radiator 4.

The radiators have supports 9 made out of a ceramic material toward each end instead of the conventional central supports. Attaching wires 11 for example can be passed through supports 9. Because of their length each radiator 4 has two supports 9 on its rear surface. When the radiators are mounted in a reflector as needed, attaching wires 11 are passed through holes 3*a*, 3*b*, or 3*c* and twisted together in back of the reflector. Power-supply lines 6 on the other hand are passed through holes 5 and connected to electric terminals in back of the reflectors.

I claim:

1. Infrared-radiating appartus comprising: ceramic radiators; reflectors supporting said radiators; hinged joint means at edges of said reflectors and having sleeve means; and connecting pin means passing through said sleeve means for hingedly interconnecting a plurality of reflectors to form a predetermined geometrical shape supporting said radiators in a predetermined arrangement; said reflectors having sloping walls connected to a correspondingly wide rear portion; said rear portion having groups of openings for mounting said radiators; said reflectors having auxiliary openings for passing power lines of said radiators; said sleeve means comprising sleeve members mutually displaced at a distance from each other so that sleeves of another reflector can be inserted therebetween to form a hinged connection between a plurality of reflectors; rod-shaped members inserted through said sleeves for assembling a plurality of reflectors in sequence; reflectors being connectable hingedly next to and behind each other; said radiators comprising elongated rectangular elements having a ceramic body with heat conductors embedded therein and terminating into power-supply lines at ends of said radiators; said radiators having supports comprised of ceramic material; attaching connecting wires being passed through said supports; each radiator having two supports on its rear surface; said attaching connecting wires being passed through openings in said reflectors and being twisted together in back of the reflectors; and power-supply lines passed through said auxiliary openings and connected to electric terminals in back of said reflectors.

2. Infrared-radiating apparatus comprising: ceramic radiators; reflectors supporting said radiators; hinged joint means at edges of said reflectors and having sleeve means; and connecting pin means passing through said sleeve means for hingedly interconnecting a plurality of reflectors to form a predetermined geometrical shape supporting said radiators in a predetermined arrangement; said reflectors having a portion with groups of openings for mounting said radiators; said sleeve means comprising sleeve members mutually displaced at a distance from each other so that sleeves of another reflector can be inserted therebetween to form a hinged connection between a plurality of reflectors; rod-shaped members inserted through said sleeves for assembling a plurality of reflectors in sequence; reflectors being connectably hingedly next to and behind each other; said radiators comprising elements having a ceramic body with heat conductors embedded therein and terminating into power-supply lines at ends of said radiators; said radiators having supports comprised of ceramic material; attaching connecting wires being passed through said supports; said attaching connecting wires being passed through openings in said reflectors; and power-supply lines connected to electric terminals in back of said reflectors.

3. Infrared-radiating apparatus as defined in claim 2, including power-supply lines at ends of the reflector.

4. Infrared-radiating apparatus as defined in claim 2, wherein said reflectors are uniform and are hinged to each other at their longer sides and articulated with bearing bolts.

5. Infrared-radiating apparatus as defined in claim 2, wherein sufficient radiators to attain a predetermined heating effect are mounted next to each other in a common reflector.

6. Infrared-radiating apparatus as defined in claim 2, wherein individual radiators can be connected independently of each other to a power supply.

7. Infrared-radiating apparatus as defined in claim 2, wherein said radiators are rod-shaped and positioned for attaining a predetermined heating effect parallel to each other in a common reflector extending over several radiators.

8. Infrared-radiating apparatus as defined in claim 2, wherein said radiators are positioned in a reflector parallel to its longitudinal axis.

* * * * *